US006714166B2

(12) United States Patent
Sasaki et al.

(10) Patent No.: US 6,714,166 B2
(45) Date of Patent: Mar. 30, 2004

(54) CONVERTER FOR SATELLITE BROADCAST RECEPTION THAT SECURES ISOLATION BETWEEN VERTICALLY POLARIZED WAVES AND HORIZONTALLY POLARIZED WAVES

(75) Inventors: Kazuhiro Sasaki, Fukushima-ken (JP); Masashi Nakagawa, Fukushima-ken (JP); Yuanzhu Dou, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/247,867

(22) Filed: Sep. 20, 2002

(65) Prior Publication Data

US 2003/0058181 A1 Mar. 27, 2003

(30) Foreign Application Priority Data

Sep. 21, 2001 (JP) ..... 2001-289804

(51) Int. Cl.[7] ..... H01Q 13/00
(52) U.S. Cl. ..... 343/785; 343/776; 343/786
(58) Field of Search ..... 343/772, 785, 343/786, 872, 776, 782

(56) References Cited

U.S. PATENT DOCUMENTS 3,806,942 A * 4/1974 Preti ..... 343/702
5,757,323 A * 5/1998 Spencer ..... 343/700 MS
6,353,417 B1 * 3/2002 Yuanzhu ..... 343/785
6,366,245 B1 * 4/2002 Schmidt et al. ..... 343/700 MS
6,469,676 B1 * 10/2002 Fehrenbach et al. ..... 343/786
6,501,432 B2 * 12/2002 Yuanzhu ..... 343/772
6,567,054 B2 * 5/2003 Yuanzhu ..... 343/785
6,614,404 B1 * 9/2003 Schmidt et al. ..... 343/753
2003/0058183 A1 * 3/2003 Nakagawa et al. ..... 343/786
2003/0068980 A1 * 4/2003 Nakagawa et al. ..... 455/13.3

FOREIGN PATENT DOCUMENTS

| | | |
|---|---|---|
| DE | 43 05 906 A1 | 9/1994 |
| EP | 1 076 379 A2 | 2/2001 |
| EP | 1 076 379 A3 | 11/2002 |
| JP | 2000-332526 | 11/2000 |
| WO | WO 99 54958 A | 10/1999 |

OTHER PUBLICATIONS

English language abstract of Japanese patent reference No. 09046102. Patent Abstracts of Japan published by Japanese Patent Office. It is believed that the abstract was published on Feb. 14, 1995.

* cited by examiner

*Primary Examiner*—Don Wong
*Assistant Examiner*—Shih-Chao Chen
(74) *Attorney, Agent, or Firm*—Brinks Hofer Gilson & Lione

(57) ABSTRACT

Each of a first minute radiation pattern and a second minute radiation pattern is provided on a first circuit board so as to be inclined electrically by about 45° from the respective axial lines of a first probe for vertically polarized waves and a second probe for horizontally polarized waves. The first minute radiation pattern is approximately perpendicular to a phase conversion portion of a first dielectric feeder, and the second minute radiation pattern is approximately parallel with a phase conversion portion of a second dielectric feeder. The phase conversion portion of the first dielectric feeder is longer than that of the second dielectric feeder.

6 Claims, 15 Drawing Sheets

CONVERTER FOR SATELLITE BROADCAST RECEPTION THAT SECURES ISOLATION BETWEEN VERTICALLY POLARIZED WAVES AND HORIZONTALLY POLARIZED WAVES

BACKGROUND OF THE INVENTION

1. Field of the Invention

The present invention relates to a converter for satellite broadcast reception for receiving radio waves that are transmitted from two satellites adjacent to each other. In particular, the invention relates to a converter for satellite broadcast reception that is suitable for the reception of circularly polarized radio waves that are transmitted from each satellite.

2. Description of the Related Art

In a converter for satellite broadcast reception for receiving radio waves that are transmitted from a plurality of satellites adjacent to each other, to receive, with one LNB (low noise block converter), left-handed polarized and right-handed polarized satellite broadcast signals that are transmitted from each of two satellites, for example, by causing those signals to enter separate waveguides, it is necessary to convert the left-handed polarized waves and right-handed polarized waves that have entered each waveguide into vertically polarized waves and horizontally polarized waves with a phase conversion portion and then receive the vertically polarized waves and the horizontally polarized waves by inputting those to a pair of probes.

As an example of such a converter for two-satellite broadcast reception, a converter is known in which dielectric feeders are held by the front end portions of two respective waveguides, a circuit board is disposed on the rear end side of the waveguides, and two sets of a probe for vertically polarized waves and a probe for horizontally polarized waves are patterned on the same surface of the circuit board in such a manner that the two sets correspond to the respective waveguides. A radiation portion and a phase conversion portion are integrated with each dielectric feeder at its respective ends in such a manner that the radiation portion projects forward from the open end of the waveguide and the phase conversion portion is inserted in and fixed to the waveguide. The probe for vertically polarized waves and the probe for horizontally polarized waves of each set are generally perpendicular to each other on the circuit board and the phase conversion portion of the dielectric feeder crosses each of the probe for vertically polarized waves and the probe for horizontally polarized waves so as to form an angle of about 45°. The circuit board is also provided with processing circuits, by which signals detected by the respective probes are frequency-converted into different intermediate frequency bands.

In the converter for two-satellite broadcast reception having the above-outlined configuration, when left-handed polarized waves and right-handed polarized waves that have been transmitted from each satellite enter one of the two dielectric feeders via the radiation portion, the left-handed polarized waves and the right-handed polarized waves are converted into vertically polarized waves and horizontally polarized waves in traveling through the dielectric feeder, which are input to the probe for vertically polarized waves and the probe for horizontally polarized waves that are provided on the circuit board. The use of the dielectric feeders having the phase conversion portions simplifies the shape of the waveguides thereby enables manufacturing cost reduction. And patterning the probes on the same surface shortens the overall length of the waveguides themselves and thereby makes it possible to reduce the size of the converter.

Incidentally, in the above conventional converter for satellite broadcast reception, since the two sets of a probe for vertically polarized waves and a probe for horizontally polarized waves are pattern on the same surface of the circuit board, there is a problem that isolation between vertically polarized waves and horizontally polarized waves is insufficient and hence a good cross-polarization characteristic cannot be obtained. To solve this problem, a technique has been proposed in which isolation between vertically polarized waves and horizontally polarized waves is secured by forming square or circular minute radiation patterns are formed on the circuit board at intersecting points of the extensions of the probes for vertically polarized waves and the probes for horizontally polarized waves.

However, each minute radiation pattern is symmetrical with respect to the axial lines of the probe for vertically polarized waves and the probe for horizontally polarized waves. Therefore, if the size (area) of each minute radiation pattern is made small, good isolation between vertically polarized waves and horizontally polarized waves cannot be obtained. Conversely, if each minute radiation pattern is made large, a problem arises that the reflection component increases to cause undue transmission loss. The use of such minute radiation patterns causes another problem. If the positional relationship between the dielectric feeder and the minute radiation pattern and other factors are not the same in the two waveguides, a phase deviation occurs between linearly polarized waves in either waveguide. Therefore, the layout of the probes and signal lines on the circuit board is determined automatically; that is, the degree of freedom in circuit designing is low.

SUMMARY OF THE INVENTION

The present invention has been made in view of the above circumstances in the art, and an object of the invention is therefore to provide a converter for satellite broadcast reception capable of increasing the degree of freedom in circuit designing while securing isolation between vertically polarized waves and horizontally polarized waves.

To attain the above object, the invention provides a converter for satellite broadcast reception having a pair of hollow waveguides, first and second dielectric feeders held by the respective waveguides, and a circuit board that is disposed perpendicularly to the axial lines of the respective waveguides in which left-handed and right-handed circularly polarized waves transmitted from each of two satellites adjacent to each other enter a radiation portion of one of the first and second dielectric feeders and are converted by a phase conversion portion of the one of the first and second dielectric feeders into vertically polarized waves and horizontally polarized waves, respectively, which are input to a probe for vertically polarized waves and a probe for horizontally polarized waves, respectively, that are provided on the circuit board, the converter comprising a first minute radiation pattern and a second minute radiation pattern each being provided on the circuit board so as to be inclined electrically by about 45° from the respective axial lines of the probe for vertically polarized waves and the probe for horizontally polarized waves, the first minute radiation pattern being approximately perpendicular to the phase conversion portion of the first dielectric feeder, the second minute radiation pattern being approximately parallel with the phase conversion portion of the second dielectric feeder, wherein the phase conversion portion of the first dielectric feeder is longer than that of the second dielectric feeder.

In the above-configured converter for satellite broadcast reception, each of the first minute radiation pattern and the second minute radiation pattern that are formed on the circuit board so as to correspond to the two respective dielectric feeders is inclined electrically by about 45° from the axial lines of the probe for vertically polarized waves and the probe for horizontally polarized waves. Therefore, the electric field disorder in each waveguide is suppressed by the relatively small, minute radiation pattern, and hence isolation between vertically polarized waves and horizontally polarized waves can be secured. Since the first minute radiation pattern is approximately perpendicular to the phase conversion portion of the first dielectric feeder and the second minute radiation pattern is approximately parallel with the phase conversion portion of the second dielectric feeder, the degree of freedom in the layout of the probes and signal lines on the circuit board is increased. Further, since the one phase conversion portion that is approximately perpendicular to the minute radiation pattern is longer than the other phase conversion portion that is approximately parallel with the minute radiation pattern, a phase deviation that is caused by the difference in the angle between the phase conversion portion and the minute radiation pattern can be corrected for, whereby satellite broadcast signals transmitted from the two satellites can be received reliably.

In the above configuration, it is preferable that one of a first pair of signal lines that are connected to the respective probes for vertically polarized waves and a second pair of signal lines that are connected to the respective probes for horizontally polarized waves be disposed close to the center of the circuit board and the other be disposed outside the one pair. This makes it possible to frequency-convert left-handed circularly polarized signals and right-handed circularly polarized signals from the two satellites into signals in different intermediate frequency bands by using common oscillators, and to thereby simplify the circuit configuration.

In the above configuration, each of the first dielectric feeder and the second dielectric feeder may be an integral mold member. However, it is preferable that each of the first and second dielectric feeders be composed of a first divisional body having the radiation portion and a second divisional body having the phase conversion portion and the first and second divisional bodies be integrated with each other by inserting a projection that is provided in the second divisional body into a through-hole that is formed in the first divisional body. Dividing each dielectric feeder into the first and second divisional bodies in this manner makes the volume (capacity) of each of the first and second divisional bodies small, and the probability of occurrence of a sink or air bubble can be lowered accordingly. Further, since each dielectric feeder is divided at the portion where the projection is joined to the surface of the through-hole and the dividing surface is distant from the center of the first divisional body where the electric field is strongest, adverse electrical effects due to the division can be made small.

In this case, it is preferable that the second divisional body have an impedance conversion portion that assumes arcs in cross section that become closer to each other as the position goes away from the open end of the waveguide toward the phase conversion portion, the projection project from an end face of the impedance conversion portion, and the first and second divisional bodies be joined to each other at the end face of the impedance conversion portion. With such an impedance conversion portion, the reflection component of radio waves that travel from the radiation portion to the phase conversion portion past the impedance conversion portion can be weakened to a large extent. Further, a large phase difference is obtained for linearly polarized waves even if the length of the portion from the impedance conversion portion to the phase conversion portion is reduced, which makes it possible to greatly reduce the total length of the waveguide.

In the above configuration, at least one of the two respective second divisional bodies of the first and second dielectric feeders may be provided with an identification mark that allows the two second divisional bodies to be discriminated from each other visually. This allows each first divisional body to be held by the corresponding waveguide reliably without causing erroneous insertion. In this case, the second divisional bodies having different lengths may be molded so as to assume different colors. This requires merely coloring an injection molding material and hence can lower manufacturing cost increase.

DESCRIPTION OF THE PREFERRED EMBODIMENT

A converter for satellite broadcast reception according to an embodiment of the present invention will be hereinafter described with reference to the drawings.

Figure 1:
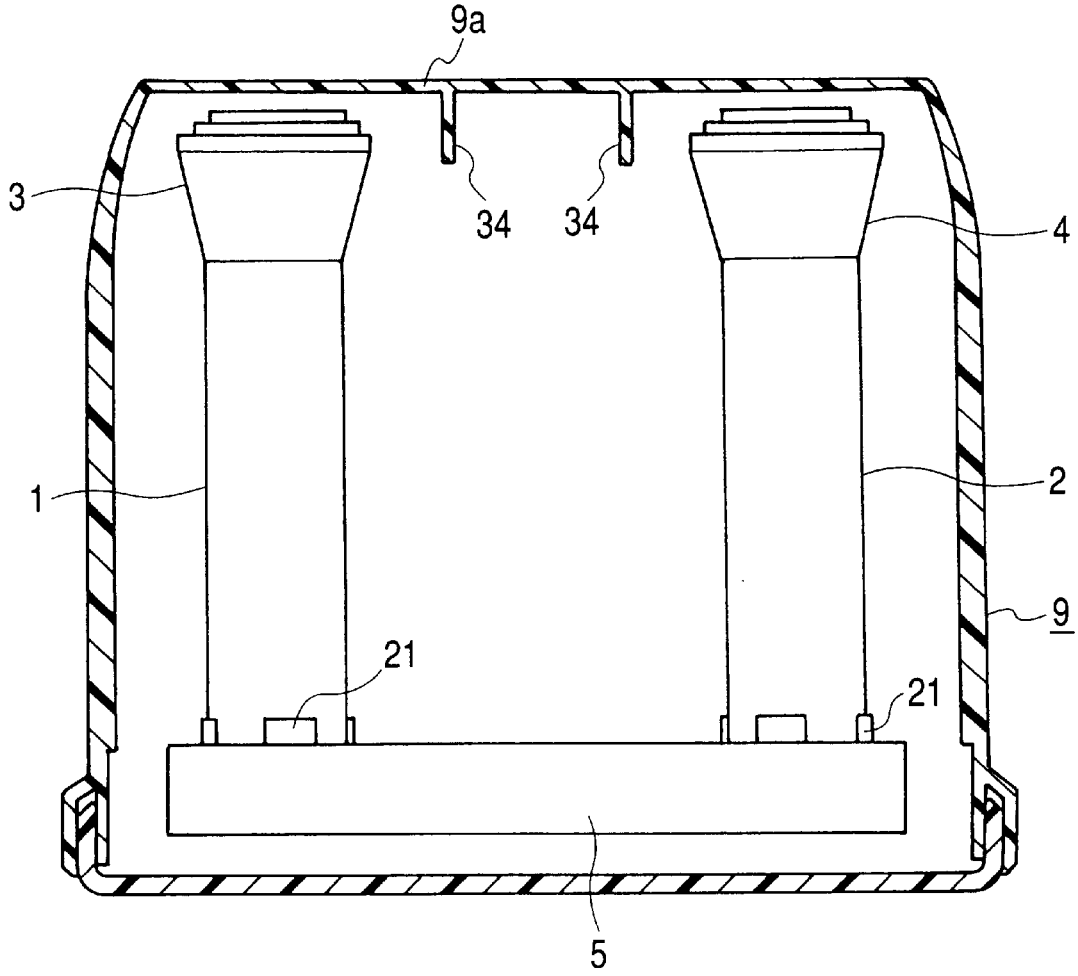
FIG. 1 is a sectional view of a converter for satellite broadcast reception according to an embodiment of the invention.
Figure 2:
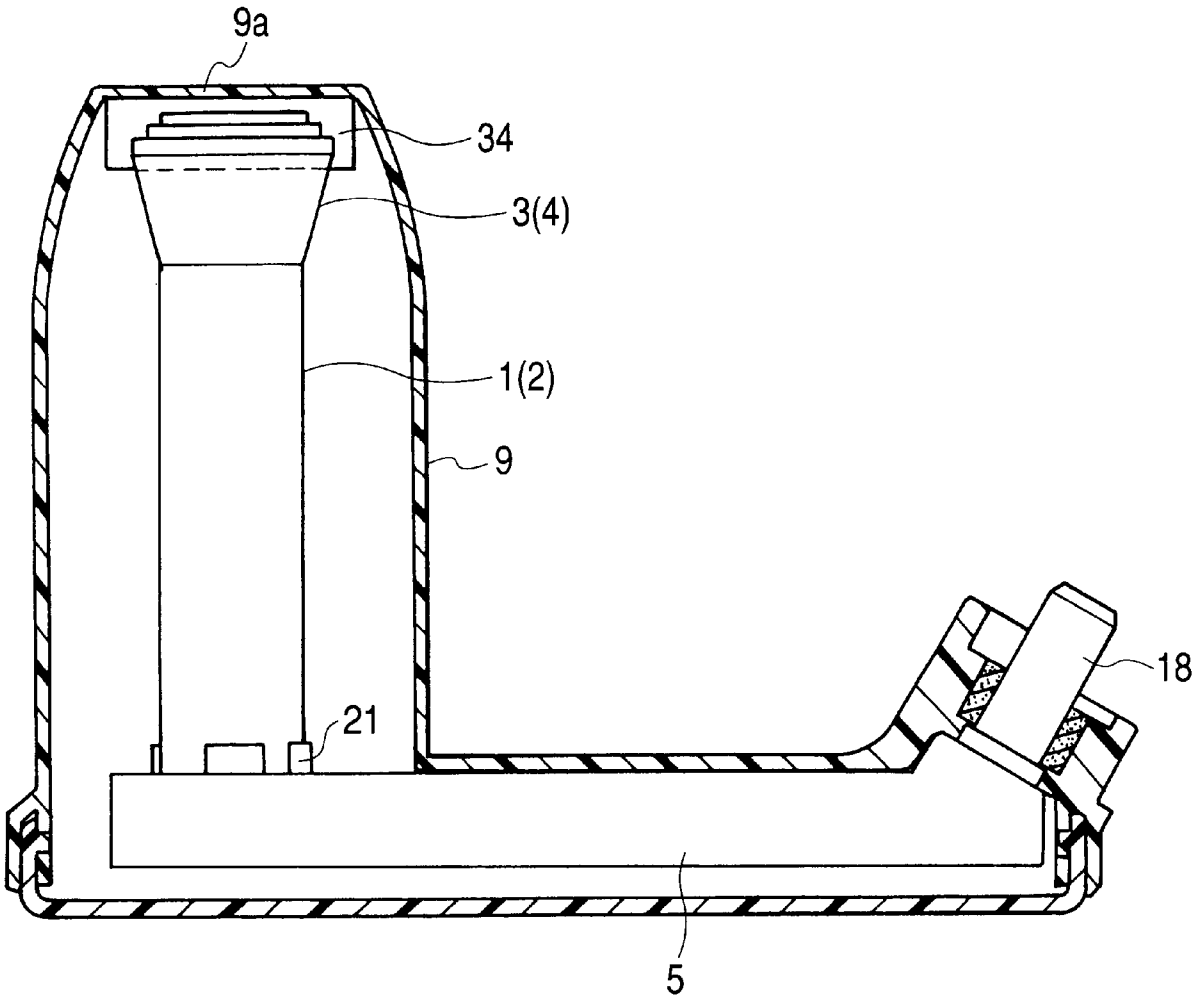
FIG. 2 is a sectional view, as viewed from another direction, of the converter for satellite broadcast reception.

As shown in FIGS. 1, 2, etc., the converter for satellite broadcast reception according to the embodiment is composed of first and second waveguides 1 and 2, first and second dielectric feeders 3 and 4 that are held by the front end portions of the respective waveguides 1 and 2, a shield case 5, first and second circuit boards 6 and 7 that are provided inside the shield case 5, a pair of short caps 8 that close the rear open ends of the respective waveguides 1 and 2, a waterproof cover 9 that covers the above parts, and other parts.

Figure 3:
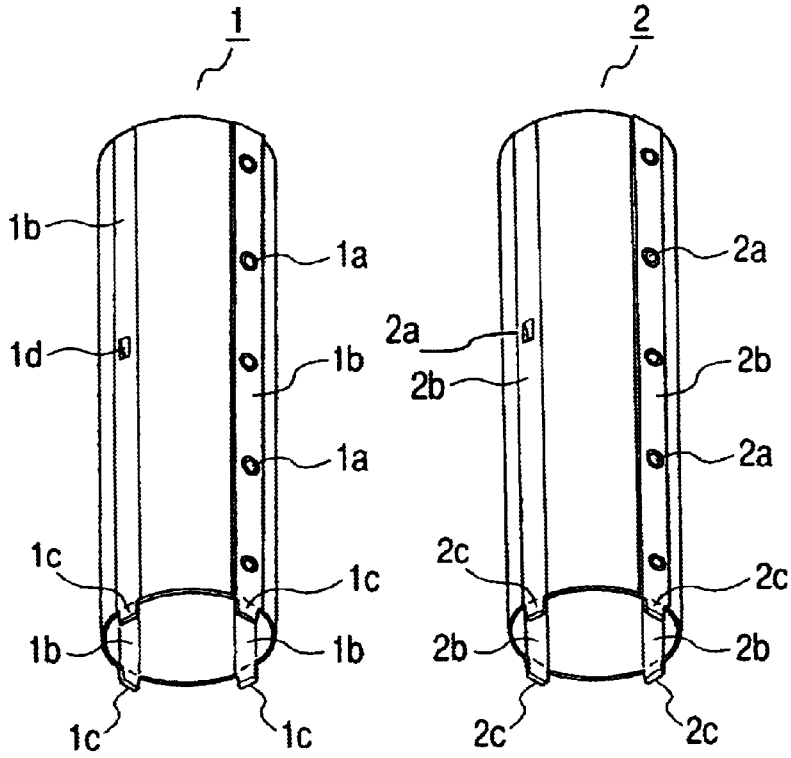
FIG. 3 is a perspective view of waveguides.
Figure 4:
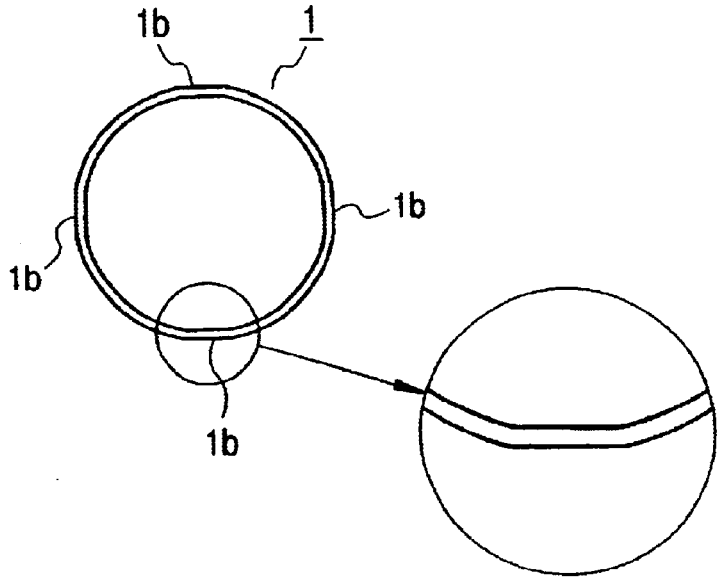
FIG. 4 is a front view of one of the waveguides.

As shown in FIGS. 3 and 4, the first waveguide 1 is configured in such a manner that a flat metal plate is rolled into a cylindrical shape, both its end portions are joined to each other, and then the joining portions are fixed to each other with caulking portions 1*a*. The distances between the caulking portions 1*a* are set at about ¼ of an in-tube wavelength λg. The first waveguide 1 has a generally circular cross-section and has, as parts of its circumferential wall, four parallel portions 1*b* that are arranged in the circumferential direction at intervals of about 90°. Each parallel portion 1*b* extends in the longitudinal direction, that is, in the direction parallel with the central axis of the first waveguide 1, and a snap nail 1*c* extends from the rear end of each parallel portion 1*b*. Each of two opposed parallel portions 1*b* is formed, at a middle position, with a stopper nail 1*d*, which projects toward the inside of the first waveguide 1. The second waveguide 2 is configured completely in the same manner as the first waveguide 1 and redundant descriptions will be omitted. The second waveguide 2 has caulking portions 2*a*, parallel portions 2*b*, snap nails 2*c*, and stopper nails 2*d*.

Figure 5:
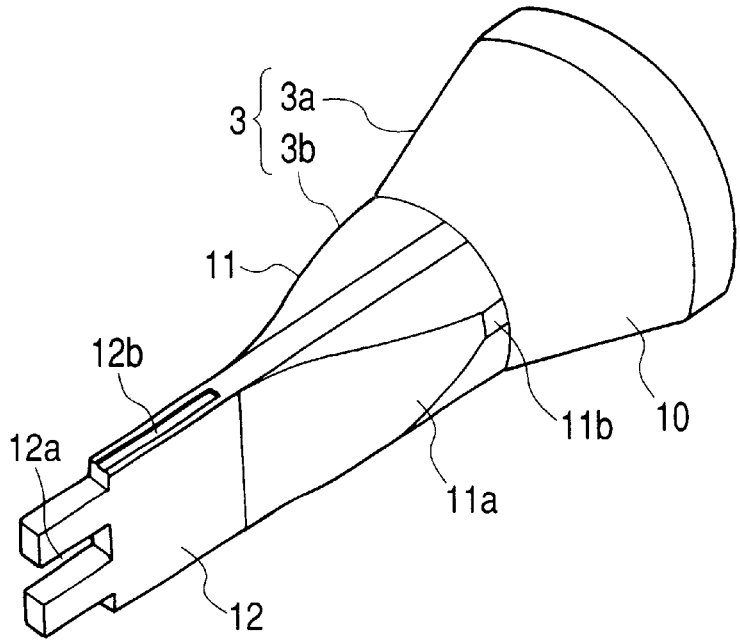
FIG. 5 is a perspective view of a dielectric feeder.
Figure 6:
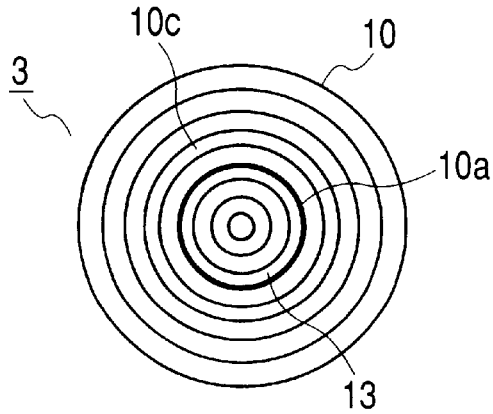
FIG. 6 is a front view of the dielectric feeder.
Figure 7:
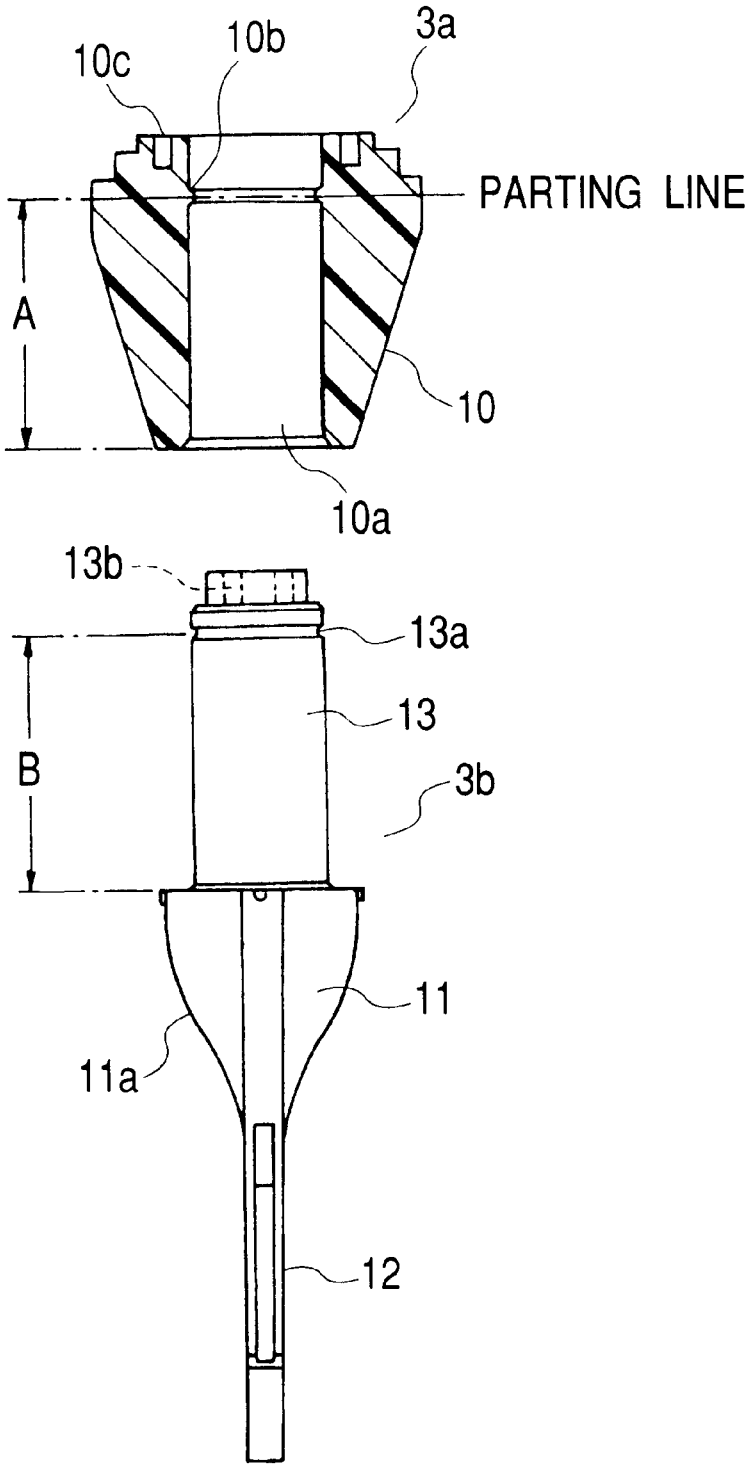
FIG. 7 is an exploded view illustrating the dielectric feeder.

The first dielectric feeder 3 and the second dielectric feeder 4 are each made of a synthetic resin material having a small dielectric loss tangent. In this embodiment, they are made of inexpensive polyethylene (relative dielectric constant $\epsilon \cong 2.25$) in consideration of the price. As shown in FIGS. 5–7, the first dielectric feeder 3 is composed of a first divisional body 3*a* having a radiation portion 10 and a second divisional body 3*b* having an impedance conversion portion 11 and a phase conversion portion 12. The radiation portion 10 assumes a conical (horn-like) shape and has a circular through-hole 10*a* at the center. The inner circumferential surface of the through-hole 10*a* is formed with a fitting projection 10*b*. When the first divisional body 3*a* is injection-molded, mold opening is done with the fitting projections 10*b* as a parting line. The wider end face of the radiation portion 10 is formed with an annular groove 10*c*, the depth of which is set at about ¼ of the wavelength λ of radio waves that travel through the annular portion.

The impedance conversion portion 11 has a pair of curved surfaces 11*a*, which assume arcs (approximately quadratic curves) in cross section that become closer to each other toward the phase conversion portion 12. The end face of the impedance conversion portion 11 is generally circular, and four flat attachment faces 11*b* are formed adjacent to the end face so as to be arranged at intervals of about 90°. The end face of the impedance conversion portion 11 is provided, at the center, with a cylindrical projection 13. The outer circumferential surface of the projection 13 is formed with a fitting recess 13*a*. When the projection 13 is inserted into the through-hole 10*a* so that the end face of the impedance conversion portion 11 butts against the rear end face of the radiation portion 10, the fitting recess 13*a* and the fitting projection 10*b* are snap-connected to each other inside the through-hole 10*a*, whereby the first divisional body 3*a* and the second divisional body 3*b* are integrated with each other.

Setting is so made that the length A from the rear end face of the radiation portion 10 to the fitting projection 10*b* is slightly greater than the length B from the end face of the impedance conversion portion 11 to the fitting recess 13*a*. Therefore, when the fitting recess 13*a* and the fitting projection 10*b* are snap-connected to each other, force occurs in such a direction as to press the rear end face of the radiation portion 10 against the end face of the impedance conversion portion 11, whereby the first divisional body 3*a* and the second divisional body 3*b* are integrated with each other with no looseness. The front end face of the projection 13 is also formed with an annular groove 13*b*. When the first divisional body 3*a* and the second divisional body 3*b* are integrated with each other, the annular grooves 10*c* and 13*b* are made concentric with each other.

Continuous with the narrow portion of the impedance conversion portion 11, the phase conversion portion 12 functions as a 90° phase shifter that converts circularly polarized waves that have entered the first dielectric feeder 3 into linearly polarized waves. The phase conversion portion 12 is a plate-like member having an approximately uniform thickness, and its tip portion is formed with cuts 12*a*. The depth of each cut 12*a* is set at about ¼ of the in-tube wavelength λg. The end faces of the phase conversion portion 12 and the bottom faces of the cuts 12*a* are two sets of reflection surfaces that are perpendicular to the traveling direction of radio waves. Both side surfaces of the phase conversion portion 12 are formed with a long groove 12*b*.

Figure 8:
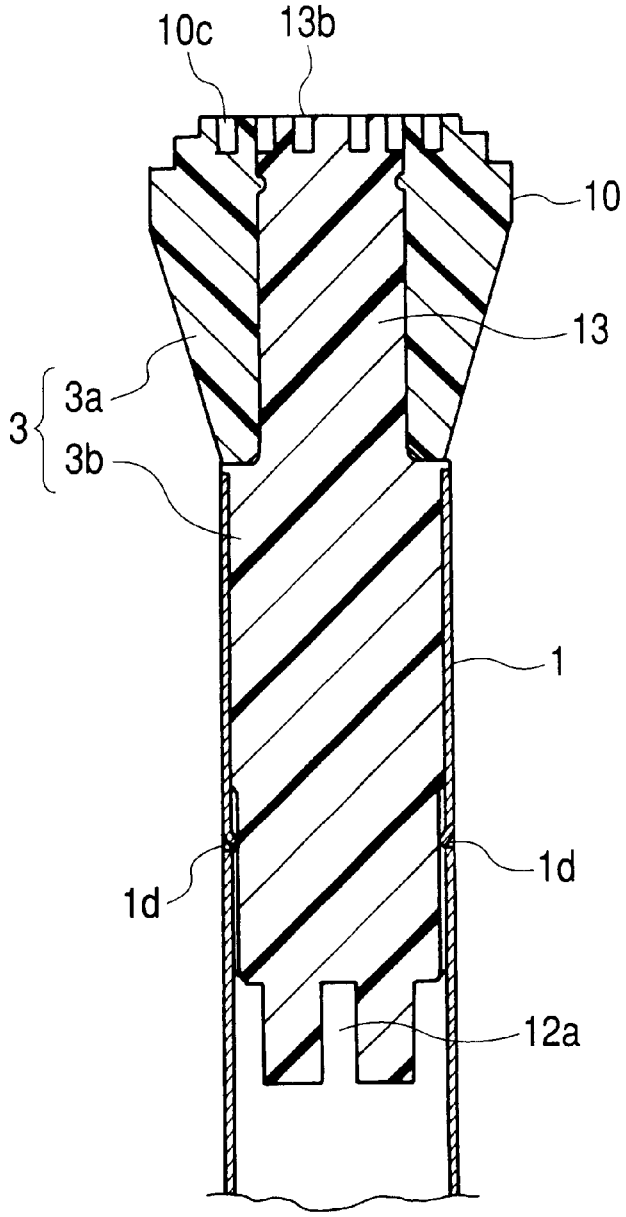
FIG. 8 illustrates a state that the dielectric feeder is attached to the waveguide.

As shown in FIG. 8, the first dielectric feeder 3 having the above configuration is held by the first waveguide 1 in such a manner that the radiation portion 10 of the first divisional body 3*a* and the projection 13 of the second divisional body 3*b* project from open end of the first waveguide 1 and that the impedance conversion portion 11 and the phase conversion portion 12 of the second divisional body 3*b* are inserted in and fixed to the first waveguide 1. When the first dielectric feeder 3 is attached to the first waveguide 1, the attachment faces 11*b* of the impedance conversion portion 11 are press-fit into the corresponding four parallel portions 1*b* of the circumferential wall of the first waveguide 1 and the two side surfaces of the phase conversion portion 12 are press-fit into the two parallel portions 1*b* that are opposed to each other (i.e., have intervals of 180°). In this manner, the second divisional body 3*b* can easily be attached to the first waveguide 1 with high positional accuracy. Further, the stopper nails 1*d* that are formed in the two parallel portions 1*b* go into the long grooves 12*b* of the phase conversion portion 12, respectively, whereby the second divisional body 3*b* can be prevented reliably from coming off the first waveguide 1.

The second dielectric feeder 4 is the same as the first dielectric feeder 3 in the basic configuration that it is composed of a first divisional body 4*a* having a radiation portion 14 and a second divisional body 4*b* having an impedance conversion portion 15 and a phase conversion portion 16 and a projection 17 of the second divisional body 4*b* is inserted in and fixed to a through-hole 14*a* of the first divisional body 4*a*. The second dielectric feeder 4 is different from the first dielectric feeder 3 in the following two points. First, the phase conversion portion 12 and 16 are different from each other in length: the length L1 of the first dielectric feeder 3 and the length L2 of the second dielectric feeder 4 have a relationship L1>L2. Second, the second divisional bodies 3*b* and 4*b* are different from each other in color: for example, the first divisional body 3*b* of the first dielectric feeder 3 is injection-molded so as to have the color of a material and the second divisional body 4*b* of the second dielectric feeder 4 is injection-molded in such a manner that a material is colored in red, blue, or the like.

Figure 9:
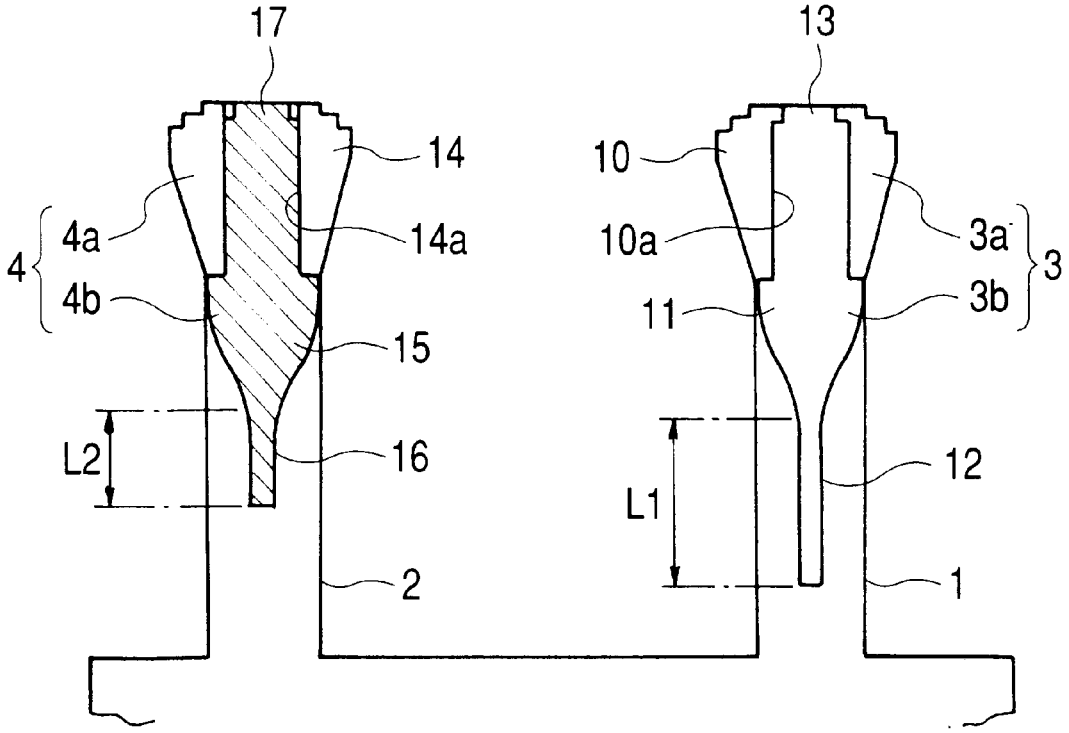
FIG. 9 illustrates differences between two dielectric feeders.

That is, among the components of the first dielectric feeder 3 and the second dielectric feeder 4, the first divisional bodies 3*a* and 4*a* are a common component and the second divisional bodies 3*b* and 4*b* are different components in which the phase conversion portions 12 and 16 are different from each other in length and color. The reason for changing the lengths of the phase conversion portions 12 and 16 will be described later. Changing the colors of the second divisional bodies 3*b* and 4*b* provides the following advantage. As shown in FIG. 9, when the first and second dielectric feeders 3 and 4 are held by the first and second waveguides 1 and 2, respectively, whether either or both of the second divisional bodies 3*b* and 4*b* are inserted erroneously can be checked easily and reliably by visually checking the colors of the projections 13 and 17 that are exposed in the end faces of the first divisional bodies 3*a* and 4*a*.

As shown in FIGS. 10–13, the shield case 5 is formed by pressing a flat metal plate and a pair of connectors 18 are attached to an inclined surface 5*a* of one side portion of the shield case 5. A pair of through-holes 19 and a plurality of holes 20 are formed through the flat top plate of the shield case 5. Support portions 21 are bent perpendicularly from the periphery of each circular through-hole 19 toward the outside of the shield case 5. Crosspieces 5*b* are formed in the top plate of the shield case 5 so as to be enclosed by the holes 20, and engagement nails 22 are bent perpendicularly from the outer peripheries of part of the crosspieces 5*b* toward the inside of the shield case 5. The back surfaces of part of the crosspieces 5*b* of the shield case 5 are formed with respective recesses 23 each of which assumes a long and narrow shape and extends along an outer peripheral line of the associated hole 20.

Figure 12:
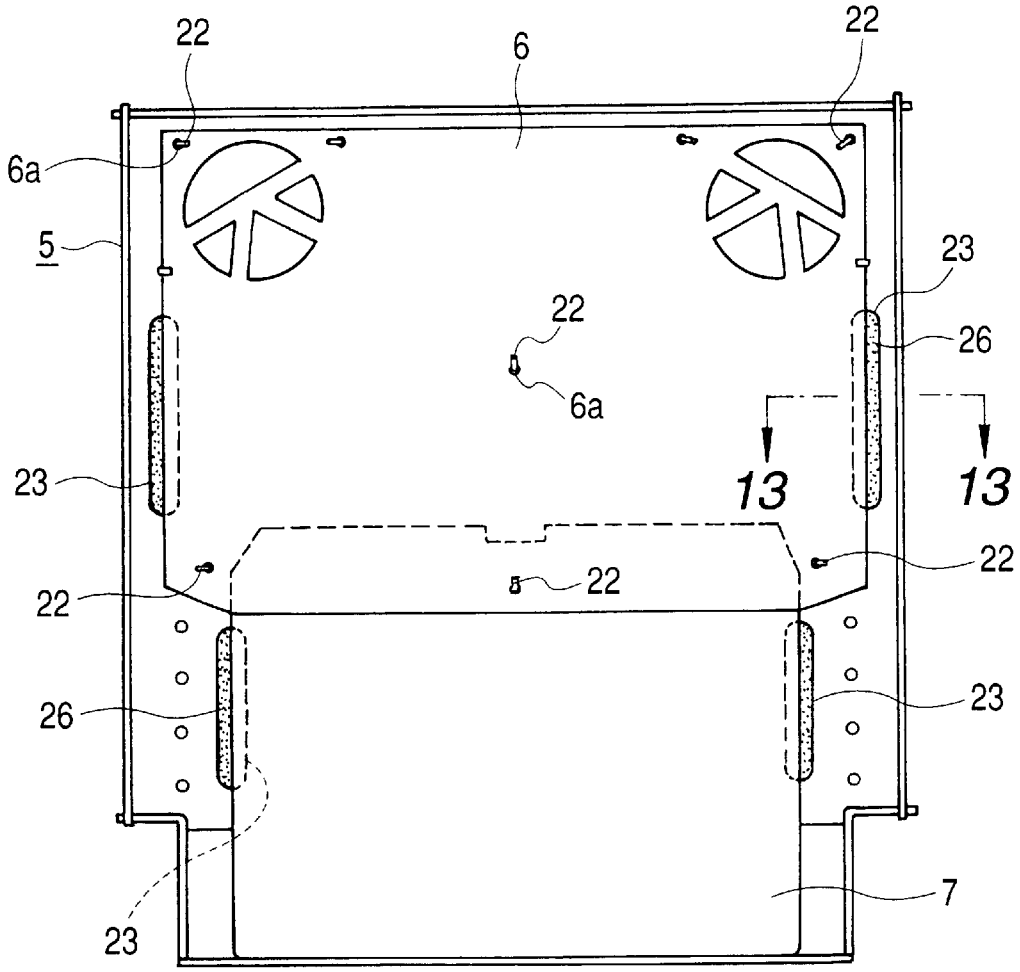
FIG. 12 illustrates a state that the circuit boards are attached to the shield case.
Figure 13:
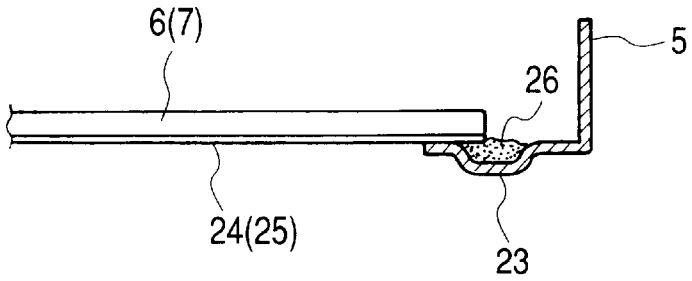
FIG. 13 is a sectional view taken along line 13-13 in FIG. 12.

The first circuit board 6 is made of polytetrafluoroethylene (fluororesin), which has a small dielectric constant and is low in dielectric loss, or a like material, and its outline is larger than the second circuit board 7. Through-holes 6*a* are formed through the first circuit board 6 at necessary positions. The second circuit board 7 is made of a material having a smaller Q value than the material of the first circuit board 6, such as an epoxy resin containing glass. One through-hole 7*a* is formed through the second circuit board 7. Ground patterns 24 and 25 are formed on one surfaces of the first and second circuit boards 6 and 7, respectively, and are soldered to the shield case 5 with solder 26 that fills each recess 23. The circuit boards 6 and 7 can be grounded to the shield case 5 easily and reliably by laying the ground patterns 24 and 25 of the circuit boards 6 and 7 on the back surface of the top plate of the shield case 5 in a state that each recess 23 has been filled with cream solder in advance and then melting the cream solder in a reflow furnace or the like. In doing so, if parts of the respective recesses 23 show out of the peripheries of the circuit boards 6 and 7 and are exposed as shown in FIGS. 12 and 13, whether there occurs a failure such as insufficient solder can easily be checked visually; an insufficient amount of solder can easily be supplied.

The first and second circuit boards 6 and 7 are not only soldered to the shield case 5 but also engaged with the back surface of the top plate of the shield case 5 with the engagement nails 22. The circuit boards 6 and 7 can be engaged with the shield case 5 by inserting the engagement nails 22 of the shield case 5 into the respective through-holes 6*a* and 7*a* of the circuit boards 6 and 7 and then bending the engagement nails 22 toward the board surface of the first circuit board 6. In particular, in the case of the first circuit board 6 which is larger than the second circuit board 7, its portions including the central portion and the peripheral portions and located at appropriate positions are pressed against the back surface of the top plate of the shield case 5 by the engagement nails 22 and hence a warp of the first circuit board 6 can be corrected reliably.

Figure 14:
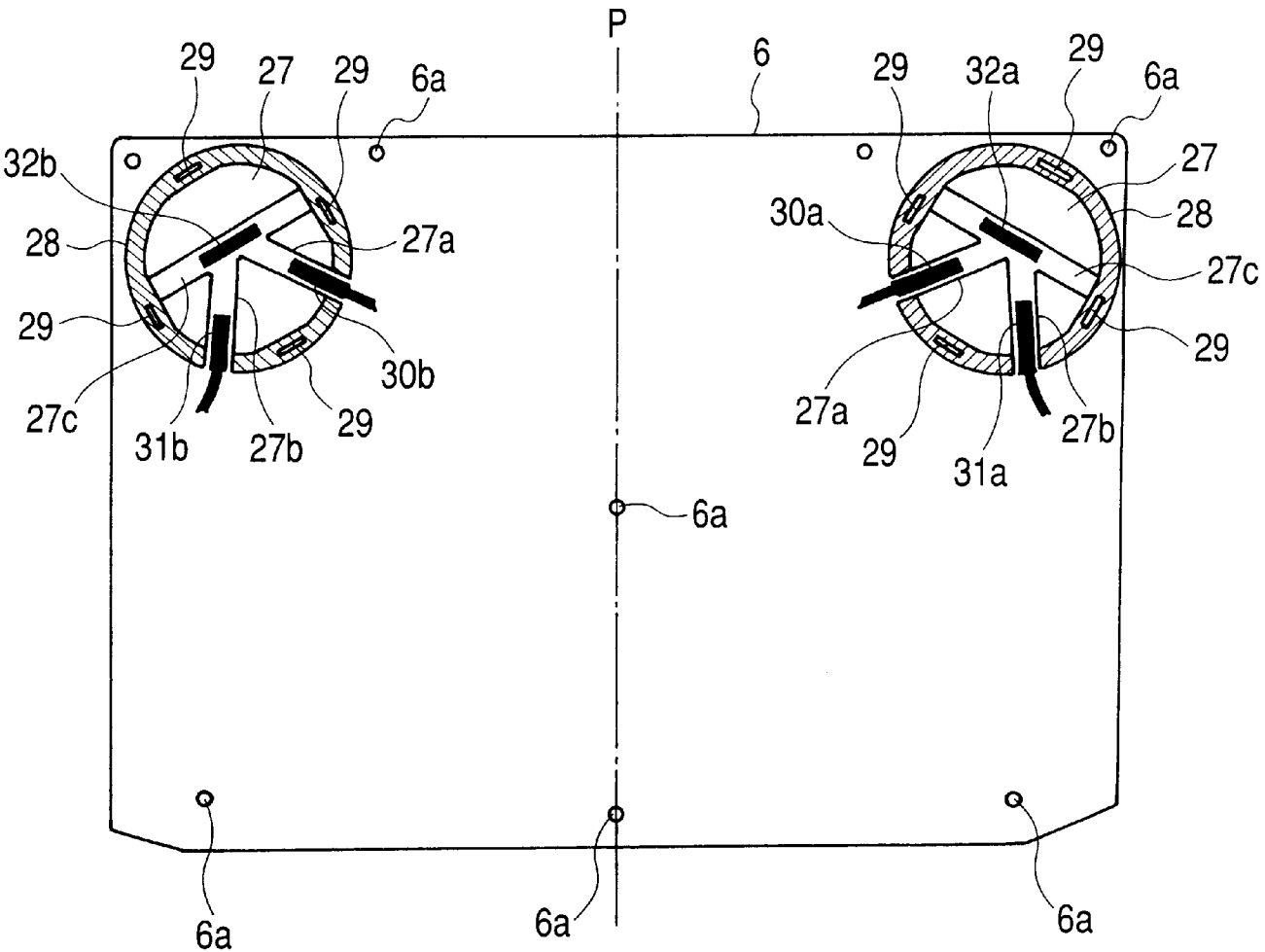
FIG. 14 shows a parts mounting surface of a first circuit board.
Figure 15:
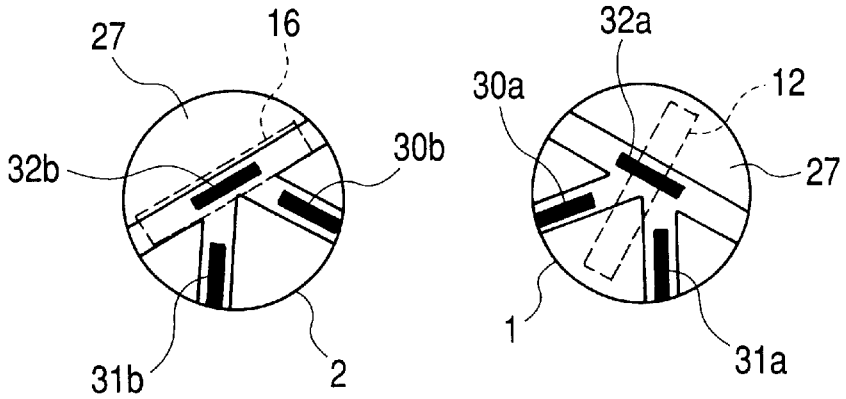
FIG. 15 illustrates a positional relationship between phase conversion portions of the dielectric feeders and minute radiation patterns.
Figure 16:
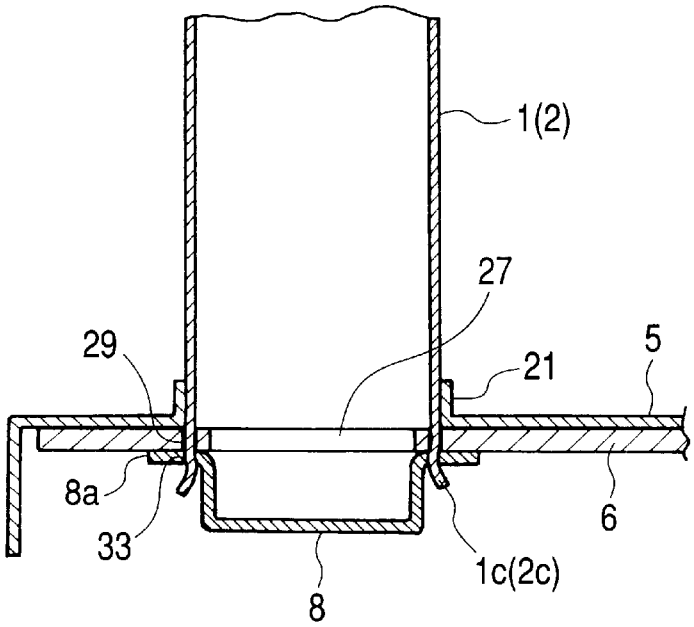
FIG. 16 is a sectional view showing how a waveguide, the first circuit board, and a short cap are attached to each other.

As shown in FIGS. 14 and 15, a pair of circular holes 27 are formed through the first circuit board 6 and first to third bridges 27*a* to 27*c* are formed in each circular hole 27. In a state that the first circuit board 6 is housed in and fixed to the shield case 5, the two circular holes 27 coextend with the respective through-holes 19 of the shield case 5. The first bridge 27*a* and the second bridge 27*b* intersect each other at an angle of about 90° and the third bridge 27*c* intersects each of the first bridge 27*a* and the second bridge 27*b* at an angle of about 45°. The bridges 27*a*–7*c* shown on the left side in the figures and those shown on the right side are symmetrical with respect to a line P passing through the center of the first circuit board 6. The surface of the first circuit board 6 opposite to the ground pattern 24 is a parts mounting surface, on which annular earth patterns 28 are formed around the respective circular holes 27. The earth patterns 28 are electrically continuous with the ground pattern 24 via through-holes. Four attachment holes 29 are formed in each earth pattern 28 so as to be arranged in the circumferential direction at intervals of about 90°. Each attachment hole 29 is rectangular, and the four attachment holes 29 on the left side in the figures and those on the right side are symmetrical with respect to the line P.

On the parts mounting surface of the first circuit board 6, a pair of first probes 30*a* and 30*b* are patterned on the respective first bridges 27*a*, a pair of second probes 31*a* and 31*b* are patterned on the respective second bridges 27*b*, and a pair of minute radiation patterns 32*a* and 32*b* are patterned on the respective third bridges 27*c*. Therefore, the left and right first probes 30*a* and 30*b*; the left and right second probes 31*a* and 31*b*, and the left and right minute radiation patterns 32*a* and 32*b* are symmetrical with respect to the line P. In the following description, the minute radiation pattern 32*a* on the right side in FIG. 14 will be called "first minute radiation pattern" and the minute radiation pattern 32*b* on the left side will be called "second minute radiation pattern."

Figure 10:
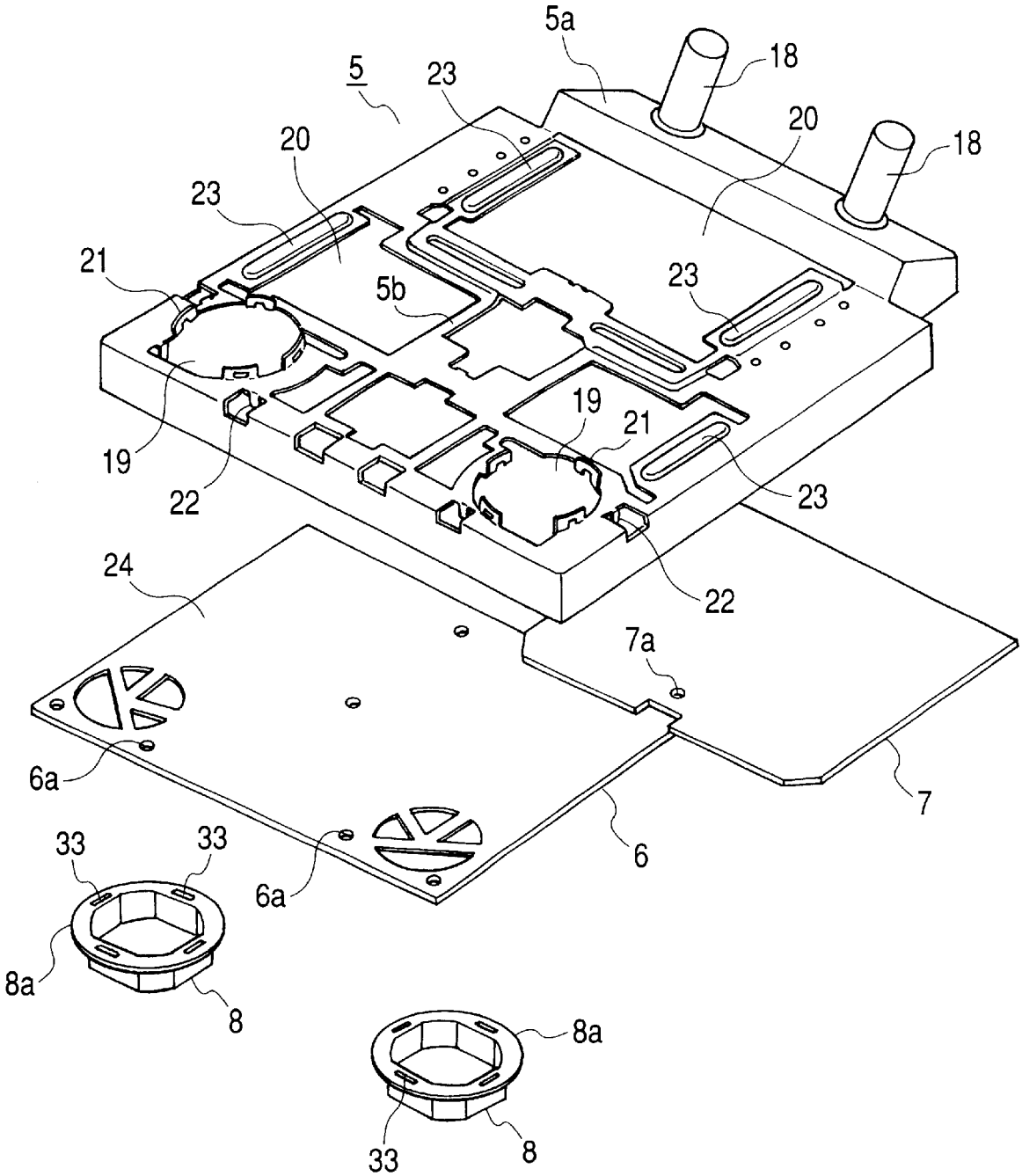
FIG. 10 is an exploded perspective view showing a shield case, circuit boards, and short caps.
Figure 11:
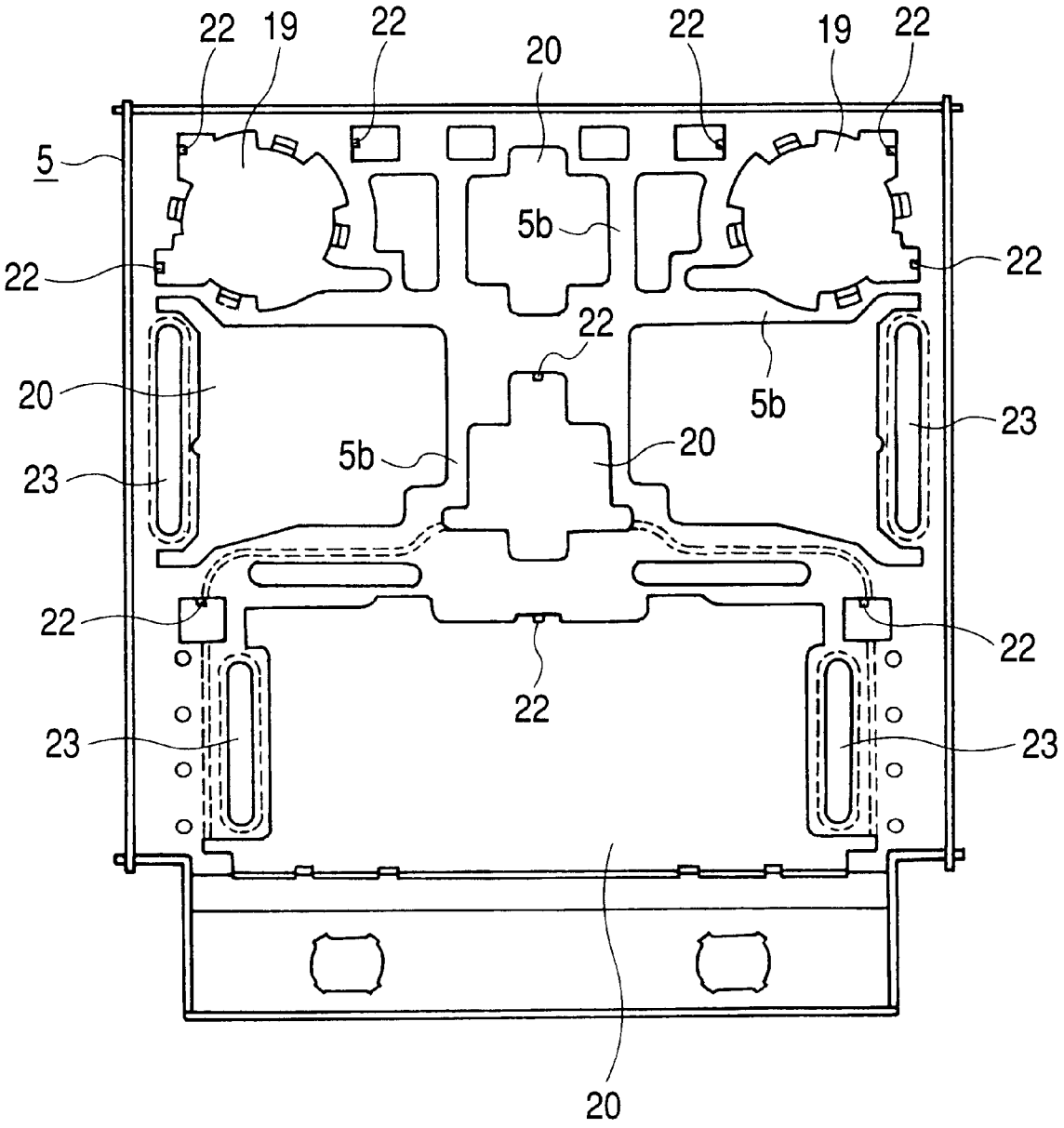
FIG. 11 is a back-side view of the shield case.

Each short cap 8 is formed by pressing a flat metal plate, and assumes a closed-end shape having a brim 8*a* on the open end side as shown in FIG. 10. Four attachment holes 33, each being rectangular, are formed through the brim 8*a* so as to be arranged in the circumferential direction at intervals of about 90°. The short caps 8 function as termination surfaces for closing the rear open ends of the two waveguides 1 and 2, respectively. As shown in FIG. 15, the short caps 8 are integrated with the first and second waveguides 1 and 2, respectively, through the first circuit board 6. More specifically, the snap nails 1*c* and 2*c* of the first and second waveguides 1 and 2 project to the back side of the first circuit board 6 through its attachment holes 29. By snap-inserting the snap nails 1*c* and 2*c* into the respective attachment holes 33 of the short caps 8, the first circuit board 6 is fixed being held between the two waveguides 1 and 2 and the pair of short caps 8. At this time, the short caps 8 are soldered to the earth patterns 28 on the first circuit board 6 by applying cream solder to the earth patterns 28 on the first circuit board 6 in advance and melting the cream solder in a reflow furnace after snap insertion of the snap nails 1*c* and 2*c*.

As described above, the first circuit board 6 is housed in and fixed to the shield case 5, and the first waveguide 1 and the second waveguide 2 are fixed to the first circuit board 6 perpendicularly. The first waveguide 1 and the second waveguide 2 pass through the through-holes 19 of the shield case 5 and project from the first circuit board 6. The two waveguides 1 and 2 are in contact with the support portions 21 that are formed around the through-holes 19, and the support portions 21 prevent undesirable deformation such as inclination of the two waveguides 1 and 2. The opening of the shield case 5 on the side opposite to the side where the two waveguide 1 and 2 project is covered with a cover (not shown).

Figure 17:
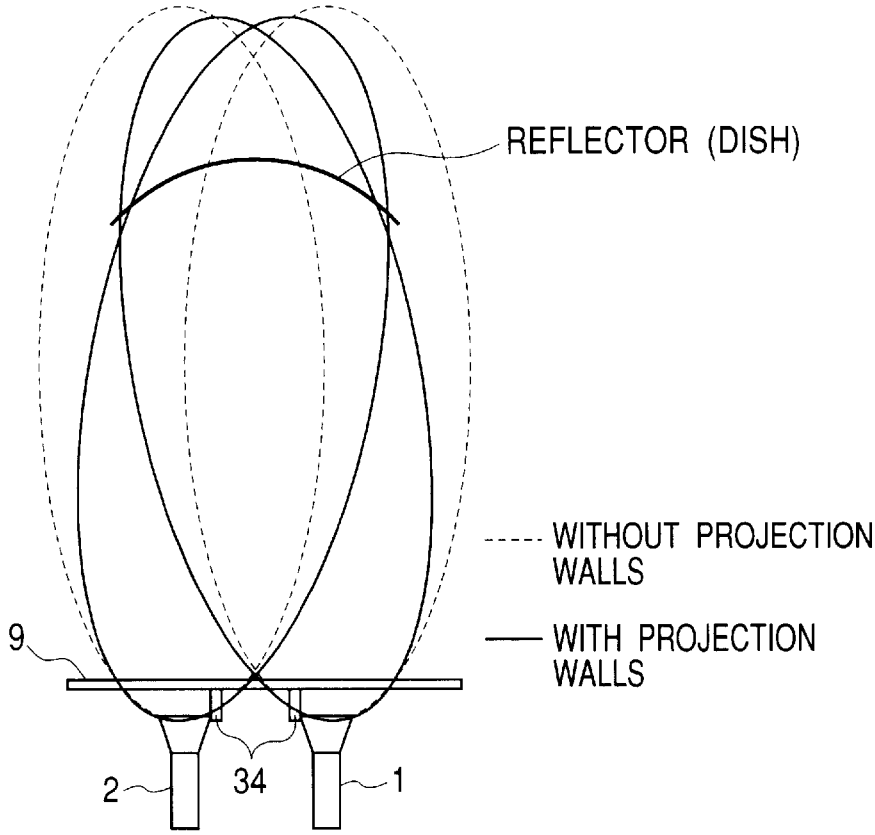
FIG. 17 illustrates a relationship between correction portions of a waterproof cover and radiation patterns.
Figure 18:
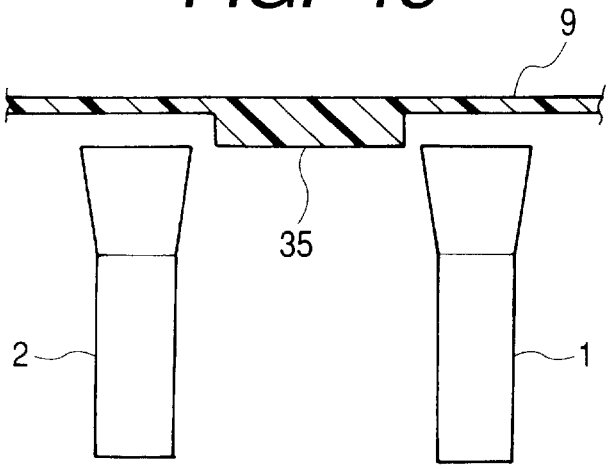
FIG. 18 illustrates a modified correction portion.

Returning to FIGS. 1 and 2, the above-described parts including both waveguides 1 and 2, both dielectric feeders 3 and 4, and the shield case 5 are housed in the waterproof cover 9 and the pair of connectors 18 project outward from the waterproof cover 9. The waterproof cover 9 is made of a dielectric material that is superior in weather resistance, such as polypropylene or an ASA resin. The radiation portions 10 and 14 of the respective dielectric feeders 3 and 4 are opposed to a front portion 9*a* of the waterproof cover 9. The front portion 9*a* is formed with a pair of projection walls 34 approximately at central positions. Both projection walls 34 extend between the first and second waveguides 1 and 2. The projection walls 34 function as correction portions: since the phase of radio waves passing through the waterproof cover 9 is delayed by the projection walls 34, the radiation patterns of radio waves entering the respective waveguides 1 and 2 can be corrected in accordance with the volume ratio between the projection walls 34. Therefore, as shown in FIG. 17, radiation patterns can be corrected from shapes indicated by broken lines (without the projection walls 34) to shapes indicated by solid lines (with the projection walls 34), which enables use of a smaller reflector (dish). As shown in FIG. 18, it is also possible to use, as a correction portion, a thick portion 35, located approximately at the center, of the front portion 9*a* of the waterproof cover 9.

The converter for satellite broadcast reception according to this embodiment is to receive radio waves that are transmitted from two orbital satellites (a first satellite S1 and a second satellite S2) adjacent to each other. Each of the first satellite S1 and the second satellite S2 transmit left-handed and right-handed circularly polarized signals, respectively, which are converged by the reflector, pass through the waterproof cover 9, and are then input to the first and second waveguides 1 and 2. For example, left-handed and right-handed circularly polarized signals that are transmitted from the first satellite S1 enter the first dielectric feeder 3 via the end face of the radiation portion 10 and the projection 13. In the first dielectric feeder 3, the signals travel through the radiation portion 10 and the impedance conversion portion 11 and reach the phase conversion portion 12, where the signals are converted into linearly polarized waves, which enter the first waveguide 1. Since a circularly polarized wave is a polarized wave in which a composed vector of two linearly polarized waves that have the same amplitude and a phase difference of 90° is rotating, the two linearly polarized waves come to have the same phase as a result of the circularly polarized waves passage through the phase conversion portion 12; for example, the left-handed polarized wave and the right-handed polarized wave are converted into a vertically polarized wave and a horizontally polarized wave, respectively.

In the above operation, since the end face of the first dielectric feeder 3 is formed with the annular grooves 10*c* and 13*b* the depth of which is approximately equal to ¼ of the wavelength λ, radio waves reflected by the end face of the radiation portion 10 and those reflected by the annular grooves 10*c* and 13*b* have opposite phases and hence cancel out each other, whereby the reflection component of radio waves going toward the end face of the radiation portion 10 are weakened to a large extent. Further, since the radiation portion 10 has a horn shape that becomes wider as the position goes away from the front open end of the first wave guide 1, radio waves can efficiently be converged into the first dielectric feeder 3 and the axial length of the radiation portion 10 can be reduced.

The impedance conversion portion 11 is provided between the radiation portion 10 and the phase conversion portion 12 of the first dielectric feeder 3, and the two curved surfaces 11*a* of the impedance conversion portion 11 have sectional shapes that are continuous, approximately quadratic curves, whereby the thickness of the first dielectric feeder 3 gradually decreases as the position goes away from the radiation portion 10 and comes closer to the phase conversion portion 12. Therefore, not only can the reflection component of radio waves traveling through the first dielectric feeder 3 be weakened effectively but also a large phase difference is obtained for linearly polarized waves even if the length of the portion from the impedance conversion portion 11 to the phase conversion portion 12 is reduced, which also contributes to great reduction in the total length of the first dielectric feeder 3.

Further, since the end face of the phase conversion portion 12 is formed with the cuts 12*a* the depth of which is approximately equal to λg/4, radio waves that are reflected by the bottom faces of the cuts 12*a* and those reflected by the end face of the phase conversion portion 12 have opposite phases and hence cancel out each other, whereby impedance mismatching at the end face of the phase conversion portion 12 can be prevented.

In this manner, the left-handed and right-handed circularly polarized signals transmitted from the first satellite S1 are converted into vertically and horizontally polarized signals by the phase conversion portion 12 of the first dielectric feeder 3. Then, the vertically and horizontally polarized signals travel through the first waveguide 1 toward the short cap 8. The vertically polarized waves are detected by the first probe 30*a* and the horizontally polarized waves are detected by the second probe 31*a*. Similarly, left-handed and right-handed circularly polarized signals transmitted from the second satellite S2 enter the second dielectric feeder 4 from the end face of the radiation portion 14 and the projection 17, and are converted into vertically polarized waves and horizontally polarized waves, respectively, by the phase conversion portion 16 of the second dielectric feeder 4. The vertically polarized waves and horizontally polarized waves travel through the second waveguide 2 toward the short cap 8, and are detected by the first probe 30*b* and the second probe 31*b*, respectively.

The first and second minute radiation patterns 32*a* and 32*b* are formed on the first circuit board 6 in such a manner that the first minute pattern 32*a* crosses each of the axial lines of the first and second probes 30*a* and 31*a* approximately at 45° and the second minute pattern 32*b* crosses each of the axial lines of the first and second probes 30*b* and 31*b* approximately at 45°. Therefore, the first and second minute radiation patterns 32*a* and 32*b* suppress distortion of the electric fields of the vertically polarized waves and the horizontally polarized waves in the respective waveguides 1 and 2, whereby isolation between the vertically polarized waves and the horizontally polarized waves is secured. The first minute radiation pattern 32*a* is a rectangle that is not symmetrical with respect to the axial lines of the probes 30*a* and 31*a*, and the second minute radiation pattern 32*b* is a rectangle that is not symmetrical with respect to the axial lines of the probes 30*b* and 31*b*. And the sizes (areas) of the first and second minute radiation patterns 32*a* and 32*b* are relatively small. Therefore, the degree of reflection by the first and second minute radiation patterns 32*a* and 32*b* can be lowered while isolation between the vertically polarized waves and the horizontally polarized waves is secured.

However, since the first and second minute radiation patterns 32*a* and 32*b* are symmetrical with respect to the line P on the first circuit board 6, as seen from FIG. 15 the first minute radiation pattern 32*a* is approximately perpendicular to the phase conversion portion 12 of the first dielectric feeder 3 and the second minute radiation pattern 32*b* is approximately parallel with the phase conversion portion 16 of the second dielectric feeder 4. In this case, the electric field distribution in the first waveguide 1 for which the first minute radiation pattern 32*a* is approximately perpendicular to the phase conversion portion 12 is worse than that in the second waveguide 2 for which the second minute radiation pattern 32*b* is approximately parallel with the phase conversion portion 16. The worsening of the electric field distribution is corrected for by increasing the axial dimension of the phase conversion portion 12. That is, as described above, the length L1 of the phase conversion portion 12 of the first dielectric feeder 3 and the length L2 of the phase conversion portion 16 of the second dielectric feeder 4 are given the relationship L1>L2 (see FIG. 9). Making the phase conversion portion 12 longer prevents occurrence of a phase deviation in linearly polarized waves traveling through the first waveguide 1.

Figure 19:
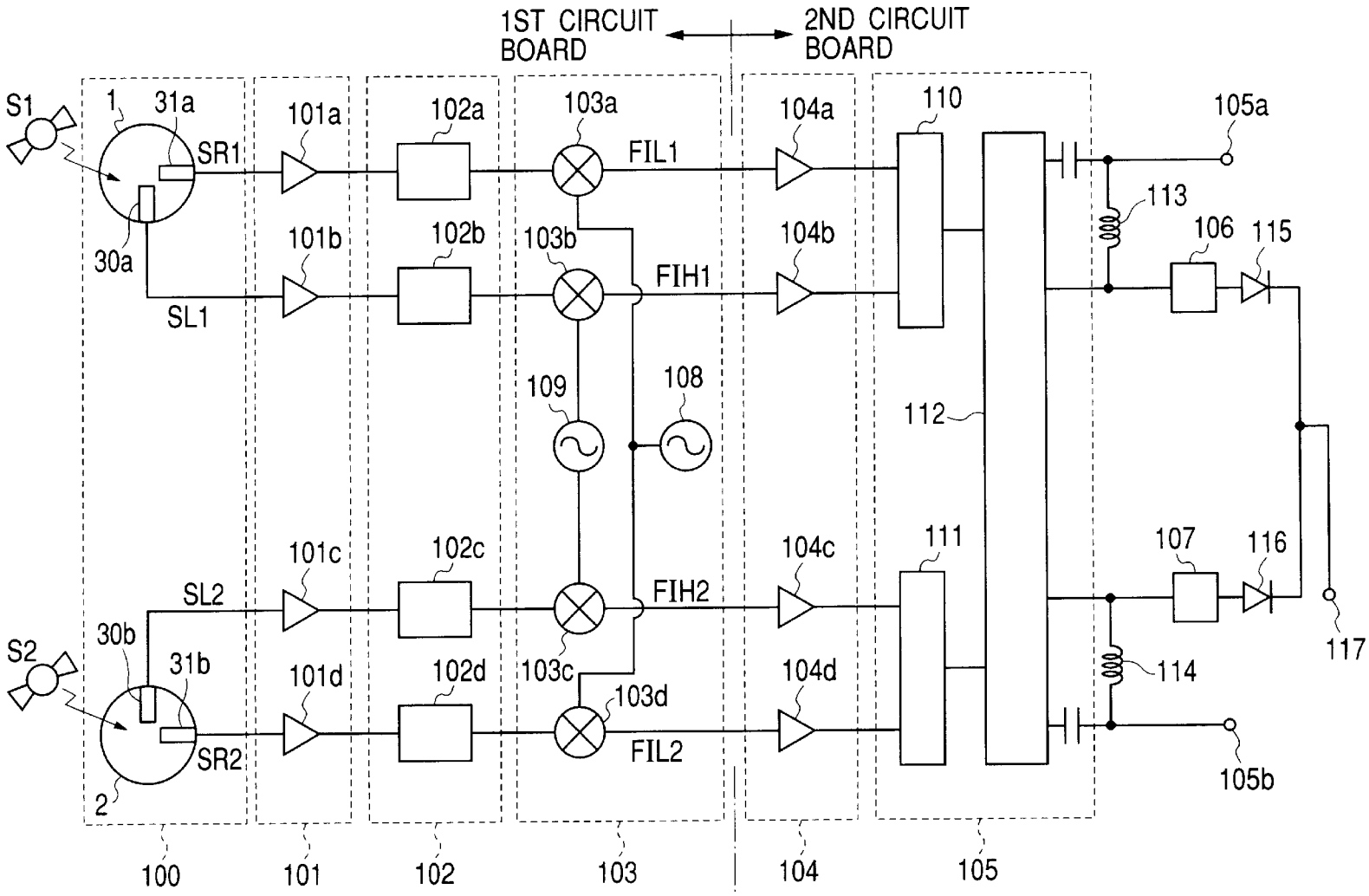
FIG. 19 is a block diagram of a converter circuit.

Reception signals that have been detected by the first probes 30*a* and 30*b* and the second probes 31*a* and 31*b* are output after being frequency-converted into IF signals by a converter circuit that is mounted on the first and second circuit boards 6 and 7. As shown in FIG. 19, the converter circuit is provided with a satellite broadcast signal input end section 100 for receiving satellite broadcast signals transmitted from the first satellite S1 and the second satellite S2 and leading the received signals to the following circuits, a reception signal amplification circuit section 101 for amplifying the input satellite broadcast signals and outputting the amplified signals, a filter section 102 for attenuating the image frequency band components of the input satellite broadcast signals, a frequency conversion section 103 for frequency-converting the satellite broadcast signals that are output from the filter section 102, an intermediate frequency amplification circuit section 104 for amplifying the signals that are output from the frequency conversion section 103, a signal selecting means 105 for selecting from the satellite broadcast signals as amplified by the intermediate frequency amplification circuit section 104 and outputting the selected signals, first and second regulators 106 and 107 for supplying supply voltages to such circuit sections as the reception signal amplification circuit section 101, the filter section 102, and the signal selecting means 105, and other circuits.

Each of the first satellite S1 and the second satellite S2 transmits left-handed polarized and right-handed polarized satellite broadcast signals of 12.2 to 12.7 GHz, which are converged by the reflector of an outdoor antenna device and input to the satellite broadcast signal input end section 100. The satellite broadcast signal input end section 100 has the first and second probes 30*a* and 31*a* for detecting left-handed polarized and right-handed polarized satellite broadcast signals that are transmitted from the first satellite S1, the first and second probes 30*b* and 31*b* for detecting left-handed polarized and right-handed polarized satellite broadcast signals that are transmitted from the second satellite S2. As described above, the left-handed polarized and right-handed polarized satellite broadcast signals transmitted from the first satellite S1 are converted into vertically polarized waves and horizontally polarized waves and then detected by the first and second probes 30*a* and 31*a*, respectively. The first probe 30*a* outputs a left-handed circularly polarized wave signal SL1 and the second probe 31*a* outputs a right-handed circularly polarized wave signal SR1. On the other hand, the left-handed polarized and right-handed polarized satellite broadcast signals transmitted from the second satellite S2 are converted into vertically polarized waves and horizontally polarized waves and then detected by the first and second probes 30*b* and 31*b*, respectively. The first probe 30*b* outputs a left-handed circularly polarized wave signal SL2 and the second probe 31*b* outputs a right-handed circularly polarized wave signal SR2.

The reception signal amplification circuit section 101 has first to fourth amplifiers 101*a*, 101*b*, 101*c*, and 101*d*. The first to fourth amplifiers 101*a*, 101*b*, 101*c*, and 101*d* receive the right-handed circularly polarized wave signal SR1, the left-handed circularly polarized wave signal SL1, the left-handed circularly polarized wave signal SL2, and the right-handed circularly polarized wave signal SR2, respectively, amplify those signals to prescribed levels, and output the amplified signals to the filter section 102.

The filter section 102 has first to fourth band elimination filters 102*a*, 102*b*, 102*c*, and 102*d*. The first to fourth band elimination filters 102*a* and 102*d* attenuate the image frequency band components (9.8 to 10.3 GHz) of a first intermediate frequency signal FIL1 to a fourth intermediate frequency signal FIL2, and the second and the third band elimination filters 102*b* and 102*c* attenuate the image frequency band components (16.0 to 16.5 GHz) of a second intermediate frequency signal FIH1 and a third intermediate frequency signal FIH2. The right-handed circularly polarized wave signal SR1, the left-handed circularly polarized wave signal SL1, the left-handed circularly polarized wave signal SL2, and the right-handed circularly polarized wave signal SR2 pass through the first to fourth band elimination filters 102*a*, 102*b*, 102*c*, and 102*d*, respectively, and are then led to the frequency conversion section 103.

The frequency conversion section 103 has first to fourth mixers 103*a*, 103*b*, 103*c*, and 103*d* and first and second oscillators 108 and 109. The first oscillator 108 (oscillation frequency: 11.25 GHz) is connected to the first mixer 103*a* and the fourth mixer 103*d*. The satellite broadcast signal as output from the first band elimination filter 102*a* is frequency-converted into a first intermediate frequency signal FIL1 of 950 to 1,450 MHz by the first mixer 103*a*, and the satellite broadcast signal as output from the fourth band elimination filter 102*d* is frequency-converted into a fourth intermediate frequency signal FIL2 of 950 to 1,450 MHz by the fourth mixer 103*d*. The second oscillator 109 (oscillation frequency: 14.35 GHz) is connected to the second mixer 103*b* and the third mixer 103*c*. The satellite broadcast signal as output from the second band elimination filter 102*b* is frequency-converted into a second intermediate frequency signal FIH1 of 1,650 to 2,150 MHz by the second mixer 103*b*, and the satellite broadcast signal as output from the third band elimination filter 102*c* is frequency-converted into a third intermediate frequency signal FIH2 of 1,650 to 2,150 MHz by the third mixer 103*c*.

Having first to fourth intermediate frequency amplifiers 104*a*, 104*b*, 104*c*, and 104*d*, the intermediate frequency amplification circuit section 104 receives the first to fourth intermediate frequency signals FIL1, FIH1, FIH2, and FIL2 as output from the frequency conversion section 103, amplifies those signals to prescribed levels, and outputs the amplified signals to the signal selecting means 105. More specifically, the first to fourth intermediate frequency signals FIL1, FIH1, FIH2, and FIL2 are input to the first to fourth intermediate frequency amplifiers 104*a*, 104*b*, 104*c*, and 104*d*, respectively, and their output signals are led to the signal selecting means 105.

The signal selecting means 105 has first and second signal combining circuits 110 and 111 and a signal switching control circuit 112. The first signal combining circuit 110 combines the input first intermediate frequency signal FIL1 and second intermediate frequency signal FIH1 and leads the combined signal to the signal switching control circuit 112. Similarly, the second signal combining circuit 111 combines the input third intermediate frequency signal FIH2 and fourth intermediate frequency signal FIL2 and leads the combined signal to the signal switching control circuit 112. The signal switching control circuit 112 chooses one of the combined signal of the first intermediate frequency signal FIL1 and the second intermediate frequency signal FIH1 and the combined signal of the third intermediate frequency signal FIH2 and the fourth intermediate frequency signal FIL2, and outputs the chosen signal to a first output end 105*a* or a second output end 105*b*. This switching control will be described later.

Separate satellite broadcast reception TV receivers (not shown) are connected to the first and second output ends 105*a* and 105*b*, respectively. Each of the satellite broadcast reception TV receivers supplies a control signal to be used for controlling the signal selecting means 105 and a voltage for operating the individual circuit sections. For example, whether to choose the combined signal of the intermediate frequency signals FIL1 and FIH1 or the combined signal of the intermediate frequency signals FIL2 and FIH2 is indicated by superimposing a control signal of 22 kHz on a DC voltage of 15 V. Specifically, to choose between reception of the right-handed circularly polarized signal SR1 and the left-handed circularly polarized signal SL1 that are transmitted from the first satellite S1 and reception of the right-handed circularly polarized signal SR2 and the left-handed circularly polarized signal SL2 that are transmitted from the second satellite S2, each satellite broadcast reception TV receiver supplies a control signal being superimposed on a supply voltage to the output ends 105*a* or 105*b*. One of these voltages (i.e., a first voltage) is input to the signal switching control circuit 112 via the first output end 105*a* and a choke coil 113 for high frequency rejection, and the other voltage (i.e., a second voltage) is similarly input to the signal switching control circuit 112 via the second output end 105*b* and a choke coil 114 for high frequency rejection.

On the other hand, the first voltage and the second voltage are input to first and second regulators 106 and 107 via the choke coils 113 and 114 for high frequency rejection, respectively, and the first and second regulators 106 and 107 supply a supply voltage (e.g., 8 V) to the individual circuit sections. To this end, first and second regulators 106 and 107 have the same configuration and are voltage regulation circuits implemented by integrated circuits. The output ends of the first and second regulators 106 and 107 are connected to a supply voltage output end 117 via diodes 115 and 116 for reverse current blocking, respectively. Therefore, even in the case where only one of the satellite broadcast reception TV receivers is in operation, a supply voltage can be supplied to the individual circuit sections. The first and second output ends 105*a* and 105*b* are connected to the supply voltage output end 117 via the first and second regulators 106 and 107, respectively. Therefore, with the device isolation function of the regulators 106 and 107, a control signal that is supplied from the first output end 105*a* is not input to the signal switching control circuit 112 via the regulators 106 and 107. Similarly, a control signal that is supplied from the second output end 105*b* is not input to the signal switching control circuit 112 via the regulators 106 and 107.

Figure 20:
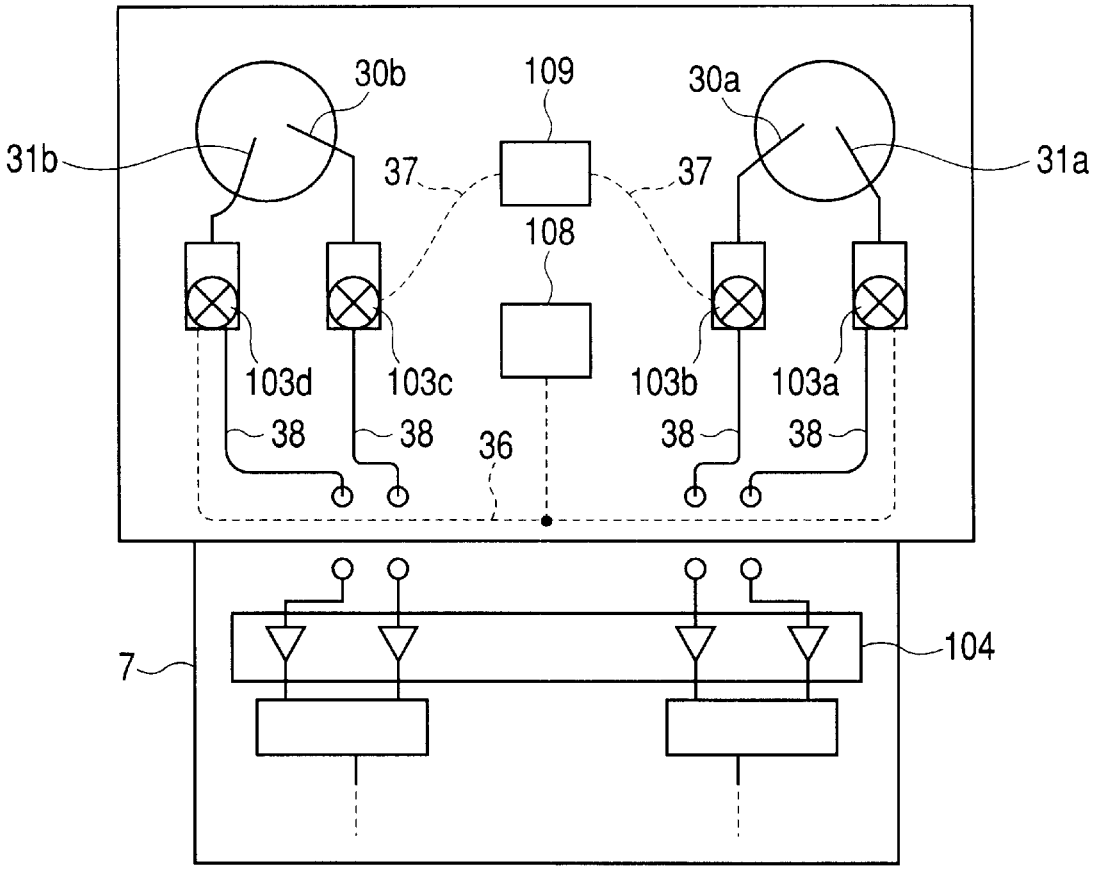
FIG. 20 illustrates a layout of circuit parts.

As shown in FIG. 20, in the above-configured converter circuit, the RF circuit components of the frequency conversion section 103 and the circuit sections upstream thereof are mounted on the first circuit board 6 and the IF circuit components of the intermediate frequency amplification circuit section 104 and the circuit section downstream thereof are mounted on the second circuit board 7. The first circuit board 6 and the second circuit board 7 overlap with each other and are joined to and integrated with each other.

More specifically, signal lines for right-handed circularly polarized signals SR1 and SR2 from the first satellite S1 and the second satellite S2 are laid out at outermost portions of the first circuit board 6 and left-handed circularly polarized signals SL1 and SL2 from the first satellite S1 and the second satellite S2 are laid out inside the above signal lines. Right-handed circularly polarized signals SR1 and SR2 that travel through the outside signal lines are converted into first and fourth intermediate frequency signals FIL1 and FIL2 of 950 to 1,450 MHz by the first and fourth mixers 103*a* and 103*d*, respectively, which are connected to the first oscillator 108. Left-handed circularly polarized signals SL1 and SL2 that travel through the inside signal lines are converted into second and third intermediate frequency signals FIH1 and FIH2 of 1,650 to 2,150 MHz by the second and third mixers 103*b* and 103*c*, respectively, which are connected to the second oscillator 109. That is, the first oscillator 108 and the second oscillator 109 are disposed at central positions of the first circuit board 6, the first oscillator 108 is connected to the outside, first and fourth mixers 103*a* and 103*d* by an oscillation signal line 36 and the second oscillator 109 is connected to the inside, second and third mixers 103*b* and 103*c* by an oscillation signal line 37.

Figure 21:
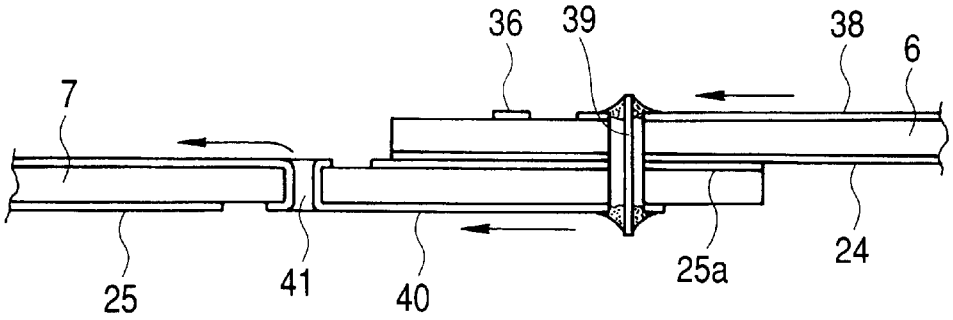
FIG. 21 is an enlarged view illustrating a portion where the two circuit boards are joined to each other.

As shown in FIG. 21, intermediate frequency signal lines 38 for carrying the intermediate frequency signals FIL1, FIL2, FIH1, and FIH2 that are output from the respective mixers 103*a* to 103*d* on the first circuit board 6 are connected to the intermediate frequency amplification circuit section 104 on the second circuit board 7 by respective connection pins 39. The ground pattern 24 that is formed on the first circuit board 6 and a ground pattern 25*a* that is formed on the parts mounting surface of the second circuit board 7 are in contact with each other in the overlap portion of the first circuit board 6 and the second circuit board 7. Lead patterns 40 are formed on the second circuit board 7 so as to be opposed to the ground pattern 25*a*. The lead patterns 40 are connected to the intermediate frequency amplification circuit section 104 of the second circuit board 7 through through-holes 41. The two ends of each connection pin 39 are soldered to the associated intermediate frequency signal line 38 and lead pattern 40, respectively. Accordingly, the oscillation signal line 36 that connects the first oscillator 108 to the first and fourth mixers 103*a* and 103*d* and the intermediate frequency signal lines 38 for leading intermediate frequency signals FIL1 to FIH2 that are output from the respective mixers 103*a* to 103*d* to the intermediate frequency amplification circuit section 104 can cross each other in the overlap portion of the first circuit board 6 and the second circuit board 7 while the ground patterns exist there.

In the above embodiment, in the converter for satellite broadcast reception in which left-handed and right-handed circularly polarized waves transmitted from each of the two satellites S1 and S2 adjacent to each other enter the radiation portion 1 or 14 of one of the first and second dielectric feeders 3 and 4 that are held by the first and second waveguides 1 and 2 and are converted by the phase conversion portion 12 or 16 of the one of the first and second dielectric feeders 3 and 4 into vertically polarized waves and horizontally polarized waves, respectively, which are input to the first probe 30*a* or 31*a* for vertically polarized waves and the second probe 30*b* or 31*b* for horizontally polarized waves, respectively, that are provided on the first circuit board 6, each of the first minute radiation pattern 32*a* and the second minute radiation pattern 32*b* is provided on the first circuit board 6 so as to be inclined electrically by about 45° from the respective axial lines of the first probe 30*a* or 31*a* and the second probe 30*b* or 31*b*. Therefore, the electric field disorder in each of the first and second waveguides 1 and 2 is suppressed by the relatively small, minute radiation pattern 32*a* or 32*b*, and hence isolation between vertically polarized waves and horizontally polarized waves can be secured. Since the first minute radiation pattern 32*a* is approximately perpendicular to the phase conversion portion 12 of the first dielectric feeder 3 and the second minute radiation pattern 32*b* is approximately parallel with the phase conversion portion 16 of the second dielectric feeder 4, the degree of freedom in the layout of the probes 30*a*, 30*b*, 31*a*, and 31*b* and signal lines on the first circuit board 6 is increased. Further, since the phase conversion portion 12 of the first dielectric feeder 3 is longer than the phase conversion portion 16 of the second dielectric feeder 4, a phase deviation that is caused by the difference in the angle between the phase conversion portion 12 or 16 and the minute radiation pattern 32*a* or 32*b* can be corrected for, whereby satellite broadcast signals transmitted from the two satellites S1 and S2 can be received reliably.

One of the first pair of signal lines that are connected to the first probes 30*a* and 31*a* for vertically polarized waves and the second pair of signal lines that are connected to the second probes 30*b* and 31*b* for horizontally polarized waves (e.g., the first pair of signal lines) is disposed close to the center of the first circuit board 6 and the other (e.g., the second pair of signal lines) is disposed outside the one pair. This makes it possible to frequency-convert left-handed circularly polarized signals and right-handed circularly polarized signals from the two satellites S1 and S2 into signals in different intermediate frequency bands by using common oscillators 108 and 109, and to thereby simplify the circuit configuration.

Each of the first dielectric feeder 3 and the second dielectric feeder 4 is composed of the first divisional body 3*a* or 4*a* having the radiation portion 10 or 14 and the second divisional body 3*b* or 4*b* having the phase conversion portion 12 or 16, and the first divisional body 3*a* or 4*a* and the second divisional body 3*b* or 4*b* are integrated with each other by inserting the projection 13 or 17 that is provided in the second divisional body 3*b* or 4*b* into the through-hole 10*a* or 14*a* that is formed in the first divisional body 3*a* or 4*a*. This makes the volume (capacity) of each of the first divisional body 3*a* or 4*a* and the second divisional body 3*b* or 4*b* small, and the probability of occurrence of a sink or air bubble can be lowered accordingly. Further, since each dielectric feeder 3 or 4 is divided at the portion where the projection 13 or 17 is joined to the surface of the through-hole 10*a* or 14*a* and the dividing surface is distant from the center of the first divisional body 3*a* or 4*a* where the electric field is strongest, adverse electrical effects due to the division can be made small.

The second divisional body 3*b* or 4*b* has the impedance conversion portion 11 or 15 that assumes arcs in cross section that become closer to each other as the position goes away from the open end of the waveguide 1 or 2 toward the phase conversion portion 12 or 16, the projection 13 or 17 projects from an end face of the impedance conversion portion 11 or 15, and the first divisional body 3*a* or 4*a* and the second divisional body 3*b* or 4*b* are joined to each other at the end face of the impedance conversion portion 11 or 15. Therefore, the reflection component of radio waves that travel from the radiation portion 10 or 14 to the phase conversion portion 12 or 16 past the impedance conversion portion 11 or 15 can be weakened to a large extent. Further, a large phase difference is obtained for linearly polarized waves even if the length of the portion from the impedance conversion portion 11 or 15 to the phase conversion portion 12 or 16 is reduced, which makes it possible to greatly reduce the total length of the waveguide 1 or 2.

Further, the second divisional bodies 3*b* and 4*b* as components of the first and second dielectric feeders 3 and 4 are molded so as to assume different colors so as to be discriminated from each other visually. This allows the second divisional bodies 3*b* and 4*b* having different lengths to be held by the corresponding waveguide reliably 1 and 2 without causing erroneous insertion.

Although in the above embodiment each of the first and second dielectric feeders 3 and 4 is composed of the first divisional bodies 3*a* and 4*a* and the second divisional bodies 3*b* and 4*b*, each dielectric feeder may be an integral mold member.

When practiced in the above-described form, the invention provides the following advantages.

Each of the first minute radiation pattern and the second minute radiation pattern that are formed on the circuit board so as to correspond to the two respective dielectric feeders is inclined electrically by about 45° from the axial lines of the probe for vertically polarized waves and the probe for horizontally polarized waves. Therefore, the electric field disorder in each waveguide is suppressed by the relatively small, minute radiation pattern, and hence isolation between vertically polarized waves and horizontally polarized waves can be secured. Since the first minute radiation pattern is approximately perpendicular to the phase conversion portion of the first dielectric feeder and the second minute radiation pattern is approximately parallel with the phase conversion portion of the second dielectric feeder, the degree of freedom in the layout of the probes and signal lines on the circuit board is increased. Further, since the one phase conversion portion that is approximately perpendicular to the minute radiation pattern is longer than the other phase conversion portion that is approximately parallel with the minute radiation pattern, a phase deviation that is caused by the difference in the angle between the phase conversion portion and the minute radiation pattern can be corrected for, whereby satellite broadcast signals transmitted from two satellites can be received reliably.

What is claimed is:

1. A converter for satellite broadcast reception having a pair of hollow waveguides, first and second dielectric feeders held by the respective waveguides, and a circuit board that is disposed perpendicularly to axial lines of the respective waveguides in which left-handed and right-handed circularly polarized waves transmitted from each of two satellites adjacent to each other enter a radiation portion of one of the first and second dielectric feeders and are converted by a phase conversion portion of the one of the first and second dielectric feeders into vertically polarized waves and horizontally polarized waves, respectively, which are input to a probe for vertically polarized waves and a probe for horizontally polarized waves, respectively, the converter comprising:

a first minute radiation pattern and a second minute radiation pattern each being provided on the circuit board so as to be inclined electrically by about 45° from respective axial lines of the probe for vertically polarized waves and the probe for horizontally polarized waves, the first minute radiation pattern being approximately perpendicular to the phase conversion portion of the first dielectric feeder, the second minute radiation pattern being approximately parallel with the phase conversion portion of the second dielectric feeder, wherein the phase conversion portion of the first dielectric feeder is longer than that of the second dielectric feeder.

2. The converter for satellite broadcast reception according to claim 1, wherein a first signal line of a first pair of signal lines that are connected to the respective probes for vertically polarized waves and a first signal line of a second pair of signal lines that are connected to the respective probes for horizontally polarized waves is disposed close to a center of the circuit board, and a second signal line of the first and second pairs of signal lines are disposed outside the respective first signal line.

3. The converter for satellite broadcast reception according to claim 1, wherein each of the first and second dielectric feeders is composed of a first divisional body having the radiation portion and a second divisional body having the phase conversion portion, and the first and second divisional bodies are integrated with each other by inserting a projection that is provided in the second divisional body into a through-hole that is formed in the first divisional body.

4. The converter for satellite broadcast reception according to claim 3, wherein the second divisional body has an impedance conversion portion that assumes arcs in cross section that become closer to each other progressing from an open end of the waveguide toward the phase conversion portion, the projection projects from an end face of the impedance conversion portion, and the first and second divisional bodies are joined to each other at the end face of the impedance conversion portion.

5. The converter for satellite broadcast reception according to claim 3, wherein at least one of the two respective second divisional bodies of the first and second dielectric feeders is provided with an identification mark that allows the two second divisional bodies to be discriminated from each other visually.

6. The converter for satellite broadcast reception according to claim 5, wherein the identification marks are provided such that the second divisional bodies of the first and second dielectric feeders are molded in different colors wherein the ID marks comprise the second divisional bodies of the first and second dielectric feeds being molded in different colors.

* * * * *